United States Patent [19]

Theurer

[11] 4,356,771

[45] * Nov. 2, 1982

[54] SELF-PROPELLED TRACK WORKING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Aug. 28, 1996, has been disclaimed.

[21] Appl. No.: 918,685

[22] Filed: Jun. 23, 1978

[30] Foreign Application Priority Data

Aug. 16, 1977 [AT] Austria ..... 5925/77

[51] Int. Cl.[3] ..... E01B 27/17

[52] U.S. Cl. ..... 104/7 B; 33/287; 104/12

[58] Field of Search ..... 104/7 R, 7 B, 10, 12; 414/1-8; 33/1 Q, 144, 146, 287, 338; 105/61

[56] References Cited

U.S. PATENT DOCUMENTS

| | | | |
|---|---|---|---|
| 2,861,699 | 11/1958 | Youmans | 414/4 |
| 3,384,033 | 5/1968 | Ruff | 105/61 |
| 3,604,117 | 9/1971 | Von Beckmann | 33/144 |
| 3,712,481 | 1/1973 | Harwood | 414/8 |
| 3,744,428 | 7/1973 | Plasser et al. | 104/12 |
| 3,796,160 | 3/1974 | Waters et al. | 104/7 R |
| 3,943,857 | 3/1976 | Theurer | 104/12 |
| 3,949,678 | 4/1976 | Theurer | 104/7 R |
| 4,165,693 | 8/1979 | Theurer | 104/7 B |
| 4,165,694 | 8/1979 | Theurer | 104/7 B |

*Primary Examiner*—Joseph F. Peters, Jr.
*Assistant Examiner*—Ross Weaver
*Attorney, Agent, or Firm*—Kurt Kelman

[57] ABSTRACT

A self-propelled track working machine comprises two separate vehicles moved along the track by respective drives. Track working tools are mounted on one of the vehicles, as well as a television camera for viewing selected ones of such tools. The vehicle drives as well as the tools are remote controlled from a central monitoring and control panel mounted on the other vehicle and transmission lines lead from the controls on the panel to the drives and to the tools, the television camera being connected to a television screen on the panel.

13 Claims, 5 Drawing Figures

SELF-PROPELLED TRACK WORKING MACHINE

The present invention relates to a self-propelled track working machine arrangement comprising a vehicle mounted for mobility on the track and including a drive for moving the vehicle along the track, track working means mounted on the vehicle, means for viewing the track working means, means for actuating the track working means, and a central monitoring and control apparatus for the drive and the track working means. The track working means may include means for correcting the position of the track, means for surveying and indicating the track position, and means for tamping ballast under ties of the track whereby the vehicle constitutes a track tamping, leveling and lining machine.

U.S. Pat. No. 3,469,534, dated Sept. 30, 1969, discloses a mobile track tamping and lining machine whose vehicle is comprised of a main frame and an auxiliary frame, each of the frames being mounted for mobility on the track on separate undercarriages and the frames being pivotally interconnected. Such mobile machines have been very successful in track surfacing operations although it has not always been possible to obtain uniform work and monitoring of the work without disadvantageously influencing the working sequence of the respective tools and surveying the track position, due to the fact that the vehicle frames are coupled together and advance intermittently together from working station to working station.

Canadian Pat. No. 726,262 discloses a mobile tamping and leveling machine and a front bogie associated therewith for supporting an end point of the reference system used in leveling the track. The bogie is self-propelled and driven independently of the main vehicle of the machine, a power transmission connecting the drive of the bogie to a remote control on the main vehicle for actuating and controlling the bogie drive. In this manner, the position of the reference system end point in relation to the main machine vehicle may be suitably selected but the accuracy of the work and monitoring cannot always be assured.

The track tamping, leveling and lining machine of U.S. Pat. No. 3,595,170 provides a television camera associated with the tamping tool assemblies of the machine to enable their operation to be controlled visually, the operator being able to center the tamping tools suitably in relation to the ties to be tamped by watching a television screen in the operator's cab. This arrangement facilitates the work of the operator in properly contering the tamping tools but an improvement in the work results and a reduction of the strains to which the operator is subjected can be obtained only to a limited degree with this means.

It is a primary object of this invention to provide a track working machine arrangement of the first indicated type which considerably increases the quality and accuracy of the track work while, at the same time, enhancing the comfort of the operator in the control and monitoring of the track working means.

This and other objects are accomplished in accordance with the invention by mounting a central monitoring and control apparatus for the drives and for the track working means on a second and separate vehicle mounted for mobility on the track, the second vehicle including a drive for moving the second vehicle along the track and the monitoring and control apparatus including remote control means for actuating the drives and for monitoring and actuating the track working means. Power transmission means connect the remote control means for actuating the drives to the drives, the remote control means for monitoring the track working means to the viewing means, and the remote control means for actuating the track working means to the actuating means therefor.

With this arrangement according to the present invention, it has unexpectedly and for the first time become feasible in a simple manner to control and monitor with increased operating comfort the work of track surfacing machines carrying a variety of track working tools, advancing intermittently along the track during the work, subjected to considerable vibrations and shocks in the course of the work and operating at a very high noise level. The simplified and highly effective control has been made possible by the arrangement of this invention because the central control and monitoring apparatus, from which the entire operation of the machine is directed, has been transferred to a separate control vehicle which is not subjected to the intermittent movements, vibrations and shocks of the main or working vehicle. This provides a quieter zone free of unwanted movements and noise where the operator can better concentrate on controlling and monitoring all operations. This new control and monitoring technology substantially reduces the physical strains on the operator so that he will tire less rapidly while greatly increasing the efficiency of the operation in each work shift. Concomitantly, the accuracy of the work is increased, particularly where the track work involves leveling and/or lining of the track, followed by tamping to fix the corrected track in its position. With the remote control of all operations from the separate control vehicle, the operator is removed spatially from the working site while being able to view the positioning of the work tools and control them accurately.

The above and other objects, advantages and features of the invention will become more apparent from the following detailed description of certain now preferred embodiments thereof, taken in conjunction with the accompanying largely simplified and schematic drawing wherein FIG. 1 shows a side elevational view of a track tamping, leveling and lining machine arrangement with a control vehicle according to the present invention;

Figure 1:
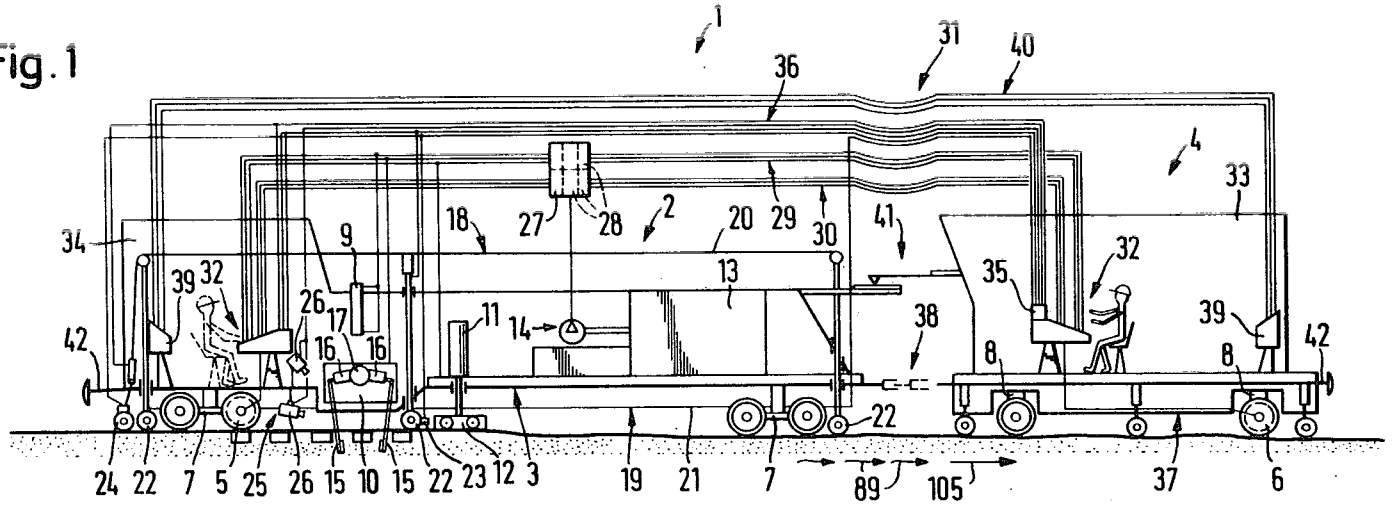

Referring now to the drawing and first to FIG. 1, there is shown a self-propelled track working machine arrangement 1 comprising a first or work vehicle 2 mounted for mobility on the track, werealong it moves in the direction of arrows 89, and including drive 5 for moving the vehicle along the track. The illustrated machine is a generally conventional track tamping, leveling and lining machine 3 whereon track working means normally used on such machines are mounted, together with their conventional actuating means. As shown, the track working means includes means for tamping ballast under ties of the track, this tamping means being constituted by tamping tool assembly 10 comprised of pairs of reciprocating vibratory tamping tools 15, and the actuating means therefor comprises hydraulic jack 9 for vertically moving the tamping tool assembly on vehicle 2, hydraulic motors 16 for reciprocating the tamping tools and vibrating drive 17 for vibrating the tamping tools while they are reciprocated for tamping ballast under respective ones of the ties. The track working means further includes track position correcting means including means for vertically and laterally moving the track, this means being constituted by a track lifting and lining unit 12, and the actuating means therefore comprises hydraulic jack 11. Furthermore, the track working means includes means for surveying and indicating the track position, this means including reference systems 18 and 19 for this vertical and lateral movement of the track. Each reference system comprises at least one reference line 20, 21, which may be a tensioned wire or a beam of radiated energy, whose end points may be vertically and laterally adjusted and which are mounted on measuring bogies 22 running on the track rails. These measuring bogies are connected to vehicle 2 by means of drives which press their flanged rollers against the respective grade rail during the lining operation. The measuring bogie in the range of tamping tool assembly 10 carries a switch 23 which is tripped by a respective track tie as the machine advances along the track. Furthermore, an odometer 24 is also mounted on vehicle 2, and switch 23 and odometer 24 are used in a known manner to control the intermittent forward movement of vehicle 2 by drive 5 during a leveling, lining and tamping operation of a track section.

Means for viewing the track working means is also mounted on work vehicle 2, the illustrated viewing means 25 being television cameras 26 mounted in the range of the tamping tool assembly and the track correction unit. The television cameras are adjustably positionable on the vehicle.

A central power source for the actuating means of the track working means is also mounted on work vehicle 2 of track tamping, leveling and lining machine 3, the illustrated power source including a hydraulic fluid tank 13 and a pump 14 for supplying hydraulic fluid from the tank to the actuating means which, in the illustrated embodiment, are hydraulic motors or jacks.

All of this structure and the operation being conventional, they have been described only generally. According to the present invention, the structure and operation is monitored and controlled from central monitoring and control apparatus 32 mounted on second and separate control vehicle 4 mounted for mobility on the track, wherealong it moves in the direction of arrow 105, and including drive 6 for moving vehicle 4 along the track. Work vehicle 2 is supported on undercarriages 7 and control vehicle 4 is supported on undercarriages 8. Central monitoring and control apparatus 32 includes remote control means for actuating drives 5 and 6, and for monitoring and actuating the track working means. Power transmission means connects the remote control means for actuating the drives to the drives 5, 6, the remote control means for monitoring the track working means to viewing means 25, and remote control means for actuating the working means to actuating means 9, 11 and 18–24, either directly or, as shown, through a control block 27 containing an array of control valves 28 which are pneumatically or electrically operated for controlling the flow of hydraulic fluid through the hydraulic control circuit connected to the hydraulic operating motors. These hydraulic control operations are also known, and, therefore, will not be described in detail herein. As shown, the power transmission means 31 comprises trunk lines 29 and 30 leading from the central control panel in operator's cab 33 on control vehicle 4 to control block 27, thus enabling an operator in that cab to monitor and control the entire operation of machine 3 in a manner to be described in some detail hereinafter. Transmission means 31 further comprises trunk line 36 connecting television cameras 26 to television screen 35 on central control panel 32. Power transmission lines 31 are constituted by flexible, longitudinally adjustable electric cables which may be protected against damage by being mounted on reeled link chains.

In the illustrated embodiment, work vehicle 2 also carries an operator's cab 34 holding a central monitoring and control apparatus 32, which makes it possible to operate machine 3 independently and without the use of a separate control vehicle, if desired. Apparatus 32 in cab 34 also includes remote control means for actuating the drives and for monitoring and actuating the track working means, and another transmission means connecting the latter remote control means for actuating the drives to the drives, and the latter remote control means for actuating the track working means to the actuating means. This arrangement makes it possible to adapt the arrangement to all operating conditions for highest efficiency and accuracy of the operation, the control and monitoring of the operation being effected selectively from cab 33 and/or from cable 34.

As shown by the relative unevenness of the track section on which control vehicle 4 runs, this section is not corrected and it may be desirable, as illustrated, to equip the control vehicle with generally conventional apparatus 37 for surveying the position and condition of the uncorrected track section. Also, particularly for moving the entire arrangement from one working site to another, it is desirable, as shown, to provide coupling means 38 interconnecting facing ends of vehicles 2 and 4 whereby the two vehicles constitute a train movable in unison along the track. Control means 39 for the common control of drives 5 and 6 are mounted at ends of vehicles 2 and 4 opposite the facing ends thereof, and brake means is provided for stopping the train. Control means 39 are interconnected by trunk line 40 for selective operation thereof, the control means in cab 33 or 34 being operated to actuate drives 5 and 6, depending on the direction in which the train is to be moved. With this arrangement, the two connected vehicles can be readily moved between working sites and are considered under general railroad operating regulations as a single car. This saves operating personnel and increases the safety when the control 39 is mounted at the end of the vehicle. Used in connection with a tamping, leveling and lining machine, as illustrated in FIG. 1, the remote control from a separate vehicle has the advantage that the identical control practiced in conventional machines of this type can now be handled from the separate vehicle without requiring retraining of personnel but while considerably easing the strains on the operator. Where the vehicles additionally have standard couplings 42, they can be used as regular railroad cars so that they may be incorporated, if desired, into any freight train for movement therewith from place to place.

Since it is desirable for control vehicle 4 not to move ahead of work vehicle 2 during operation of machine 3 by an excessive distance, a control 41 is mounted between the two vehicles. This control is designed to transmit an electrical control signal in response to the relative longitudinal movement of a gliding contact fixed to vehicle 4 and a resistance track fixed to vehicle 2. As the gliding contact moves over the resistance track when vehicle 4 moves substantially non-stop along the track, control 41 can keep this vehicle at a substantially constant speed and a desired distance from vehicle 2 which moves intermittently from tie to tie. In this manner, the remote controls on vehicle 4 are in no way influenced by the intermittent movements, vibrations and shocks of vehicle 2.

Central monitoring and control apparatus 32, with television screen 35, is schematically shown on an enlarged scale in FIG. 2 and the monitoring and control operations, which are generally conventional, will be described briefly in connection with the schematically illustrated remote control means shown in this figure.

As shown, the remote control means for actuating drives 5 and 6 and for actuating track working means 10 and 12 are connected by trunk lines 29 and 30 to control valves 28 which control the hydraulic control circuit for actuating motors 9, 11 and 16 while trunk line 36 connects television cameras 26 to television screen 35 for monitoring the operation. The remote control means on central monitoring and control panel 32 comprise a pneumatic control 43, a hydraulic control 44, an automatic control and monitoring instrumentation 45, a track position indicating instrumentation 46, a leveling control 47, a lining control 48, a tamping and drive control 49 and a track position recording device 50 which is part of track position indicating instrumentation 46.

In operation, when the coupled machine arrangement 1 arrives at a working site, it is stopped by operating brake control valve 51. Coupling means between vehicles 2 and 4 is then disconnected so that the two vehicles may move independently along the track, switch 52 being thrown from switching position I (used for the common operation of drives 5 and 6 during the movement of two-vehicle arrangement 1 between working sites) to switching position II (used for separate operation of the vehicle drives during operation of machine 3). In switching position II, central power source 13 is connected to delivery device 14 so that the power from source 13, i.e. hydraulic fluid in the described and illustrated embodiment, is delivered to the actuating means, i.e. to hydraulic motors by a pump in the described and illustrated embodiment. At the same time, drive 5 of vehicle 2 and its brakes are connected to remote control means on panel 32. After the operation of master switch 52, pneumatic control 43 is operated for proper positioning of measuring bogies 22 of reference systems 18 and 19. These measuring bogies are positioned by pneumatically operated motors and operation of air flow control valves 53, 54 causes the measuring bogies to be lowered onto the track rails and reference wires 20, 21 to be tensioned to set the reference systems in operative position. The pneumatically operated motors for tensioning of the reference wires may be monitored by manometer 55 while the air pressure for positioning the measuring bogies is monitored by manometer 56. When machine 3 is not in operation, tamping tool assembly 10 and track lifting and lining unit 12 are locked by pneumatic devices in inoperative positions off the track. These devices are unlocked to enable assembly 10 and unit 12 to be moved into their operative positions by operating air flow control valves 57, 58. Respective ones of the flanged wheels of measuring bogies 22 are pressed against a selected grade rail by pneumatically operated motors under the control of air flow control valve 59.

With the reference systems thus in position, hydraulic control 44 is operated for actuating tamping tools 15. Hydraulic fluid flow control valves 60, 61 are opened to start operation of vibrating drives 17 on each tamping tool assembly associated with a respective track rail. Operation of hydraulic fluid flow control valve 62 causes the reciprocating motors 16 to apply a pre-set opening pressure to open the tamping tools. Hydraulic fluid flow control valve 63 is used to end the approaching movement of the tamping tools at the end of tamping when a pre-set tamping pressure has been reached. The adjustment of the required operating pressures in the various lines of the hydraulic control circuit for vibrating drive 17 and reciprocating drives 16 is effected by means of manometer 64 which can be connected to selected hydraulic lines by selector switch 65. Further hydraulic fluid flow control valves 66, 67 serve to fix into position cylinders mounted between the undercarriages and the frame of vehicle 2 to inactivate spring suspensions and thus to hold the vehicle frame rigidly in position during operation of machine 3, and to release the pressure in the hydraulic control circuit.

With machine 3 thus ready for operation, track leveling control 47 is operated for supplying the required track position correction parameters to reference systems 18 and 19. Control element 68 determines whether the left or right rail is to be superelevated by an amount set on adjustable digital potentiometer 69, the amount illustrated in the drawing on potentiometer 69 being 1 mm. Switch 70 is then operated to lower track lifting and lining unit 12 onto the track after it has been unlocked by operation of control valve 58. Selector switch 71 serves to start the track lifting and has three switch positions, i.e. "premature", "out" and "operative". Push buttons 72 serve to switch the track lifting operation on and off while push buttons 73 serve to adjust the lifting stroke, i.e. the height of the end point of reference line 18 facing control vehicle 4, which rests on the uncorrected track section.

Track lining control 48 comprises digital potentiometer 74 on which may be set a parameter (15 mm in the illustrated embodiment) by which an end point of reference line 19 in the uncorrected track section may have to be laterally displaced. Control element 75 is then operated to select between manual lining or automatic lining. In manual lining, the lining stroke is controlled by the manual operation of an operating button associated with control element 75. In automatic lining, the lining stroke is controlled in an automated operating cycle. Switches 76 and 77 serve to determine whether standard lining pressure is to be used or whether extra lining pressure is to be applied in case a heavy track section is lined, and whether lining is to be effected simultaneously with tamping or without tamping. The adjustment potentiometers 78 serve to adjust lining indicator instrument 79 of track position indicating instrumentation 46 and to increase the lining pressure when switch 77 has been operated.

Instrumentation 46 also comprises superelevation indicator instrument 80 and superelevation control instruments 81 for the left and right rail. After all the adjustments have been set, machine 3 may be centered over the first tie to be tamped by operating push button 82 of automatic control and monitoring instrumentation 45. Depressing of push button 82 causes vehicle 2 to advance the release of the button automatically brakes the vehicle in its centered position. When machine 3 is manually operated, control element 83 of drive control 49 is operated to actuate drive 6 and thereby to impart to vehicle 4 a predetermined continuous forward speed. Push button 84 is then depressed to actuate hydraulic jack 9 and thereby to lower tamping tool assembly 10, and subsequent operation of push button 85 initiates the closing motion of tamping tools 15 by reciprocating hydraulic motors 16. Operation of switch 86 determines whether both tamping tool assemblies 10 are to be lowered into operative position or whether only one of the assemblies associated with a selected rail is to be lowered. At the end of the tamping, push button 87 is depressed to raise the tamping tool assembly of assemblies. Operation of push button 88 enables repeated reciprocatory motions of the tamping tools in the lowered position of the tamping tool assemblies.

After the track position indicating instrumentation 46, including the visual track position recorder 50, show the track section to have been properly leveled and lined, push button 82 is depressed to cause machine 3 to advance to the next tie after the tamping tool assemblies have been raised. Centering of the tamping tools 15 with respect to the tie to be tamped is facilitated and assured by the ability of the operator to view the range of the tamping tool assemblies 10 as well as the track lifting and lining unit 12 by means of television screen 35 connected to cameras 26. Suitable controls are associated with the television screen to adjust the viewing range of the cameras as well as the picture quality. If the machine in its intermittent advance indicated by sequential arrows 89 comes to a double tie, the operator may increase the opening width of tamping tools 15 by operating control element 90. The outward movement of reciprocating drives 16 is normally limited by pneumatically operated abutments and, when a wider opening motion is desired, these abutments are disengaged by operation of air flow control valve 91 of pneumatic control 43.

If desired, the control of the machine operation may also proceed automatically by throwing selector switch 92 from its "manual" to its "automatic" position. In automatic operation, selector switch 93 of instrumentation 45 may be set to determine whether reciprocation of tamping tools 15 for tamping ballast therebetween under the ties is terminated in response to an adjustable timer 94 which sets a desired tamping time or in response to an end pressure set to a predetermined value by control 44. Swtich 95 selects whether the tamping tools are reciprocated once or twice during each tamping stage. Switch 96 selects whether the tamping tool assemblies are centered over the rails wherewith they are associated by manual controls or automatically while switch 97 enables the vehicle to move back and forth if the tamping tools are found not to be properly centered with respect to the tie to be tamped. Selector switch 98 sets the time when braking is initiated after vehicle 2 has advanced from the last tamped tie, in response to the location of the next tie to be tamped sensed by switch 23. Push buttons 99 serve to adjust the automatic advancement of the vehicle. Push button 100 may be depressed to sound a warning horn and push button 101 serves to stop drive 5.

After all the appropriate adjustments have been set, depression of push button 102 will initiate the automatic cycle of advancement of machine 3 in the direction of arrows 89 and this cycle may be terminated at the end of the operation or in case of accidents or when otherwise desired by depressing push button 103. During the automatic tamping, leveling and lining cycle proceeding during the intermittent stoppages of machine 3 along the track, minor lifting adjustments of the order of magnitude of 1, 2 or 3 mm may be made by operating push buttons 104 mounted below superelevation control instruments 81 of instrumentation 46 to take into account local unevenness in the track level.

Track position recorder 50 is equipped with suitable control elements for operating the recorder and to select the desired scale in which the parameters measured by reference systems 18, 19 and surveying apparatus 37 are recorded.

Figure 2:
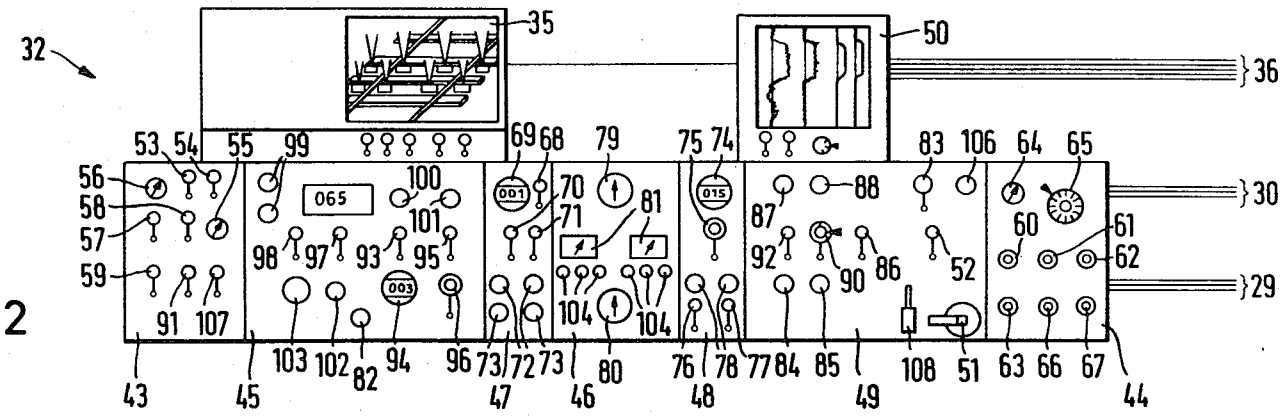
FIG. 2 is a plan view of the central control and monitoring panel for the machine.

As is apparent from FIG. 2, the operator in cab 33, which moves at a steady speed in the direction of arrow 105, can readily and single-handedly control the entire operation of the machine from central monitoring and control panel 32. While work vehicle 2 of machine 3 intermittently advances in the direction of arrows 89 under manual or automatic control, drive 6 of control vehicle 4 is continuously actuated under the control of signal transmitter 41 so that the control vehicle advances non-stop at slightly varying speeds to maintain a desired distance between vehicles 2 and 4, which is usually chosen at about one meter. Keeping a desired distance will prevent damage to the power transmission lines by an excessive distance between the vehicles. As soon as vehicle 4 advances a pre-set distance from vehicle 2, a control signal transmitted by transmitter 41 will correspondingly slow drive 6.

At times, it is necessary for machine 3 to move back over a surfaced track section and, in this case, push button 106 of drive control 49 is depressed to operate a hydraulic fluid flow control valve causing drive 6 to idle. With drive 5 reversed to move vehicle 2 in a direction opposite to that indicated by arrows 89 and drive 6 idling, coupling means 38 is operated to interconnect the vehicles as soon as a control signal from transmitter 41 indicates a desired distance between the vehicles to have been reached, whereupon vehicle 2 pulls vehicle 4 and, if necessary, the movement of vehicle 4 may be braked either from cab 34 or 33.

After completion of an operating cycle along a chosen track section, the above-described remote controls are operated to lift the tamping tool assemblies and the track lifting and lining unit, which are then locked in their inoperative positions off the track by depressing push button 107 of pneumatic control 43, whereupon switch 52 is thrown back into position I. The driving speed of the machine along the track can be adjusted by control element 108 of drive control 49. The controls for the central drive, for example a Diesel motor, may be arranged on control means 39.

Figure 3:
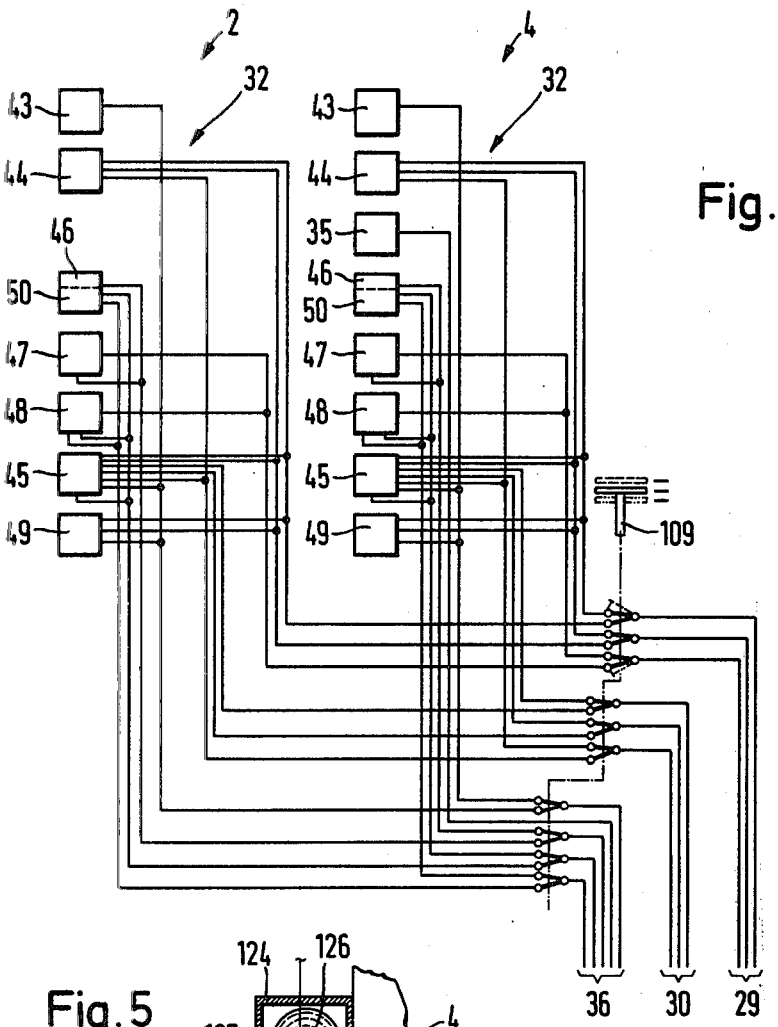
FIG. 3 is a greatly simplified circuit diagram illustrating the power transmission means between the remote control means on the central monitoring and control panel and the actuating means for the track working means.

The control circuit diagram of FIG. 3 shows how the electric control lines 29, 30 and 36 of controls 43 to 49 of central monitoring and control apparatus 32 on work vehicle 2 and control vehicle 4 are connected to enable the controls to be operated selectively from one or the other operator's cabs 33, 34, or from both cabs. As schematically illustrated, the respective output lines from the various controls are connected to switching device 109. In the illustrated rest position, this device enables the operation to be controlled from both panels 32. In the upper position of switching device 109 shown in broken lines, only the control lines coming from the control panel in cab 33 are connected to trunk lines 29, 30 and 36 while the switching device in the lower position indicated by chain-dotted lines connect only the control lines coming from the control panel in cab 34 with the trunk lines. The television screen 35 on control panel 32 in cab 33 is always operative, regardless of the operating position of switching device 107 so that, whether the machine 3 is operated from cab 33 or 34, the operator in cab 33 can always view the operation of the track working means.

Where the remote control means for actuating the track working means on control vehicle 4 includes means for surveying the corrected position of the track and, as shown, the control vehicle also comprises means 37 for surveying the position of the uncorrected track whereon vehicle 4 moves, particularly where the trend of the track lining may be monitored, for instance by means of colored markers on the ties or ballast, it is possible to sense the uncorrected track position in relation to the corrected track position on the control vehicle, which precedes the work vehicle in the operating direction, so that the operator in cab 33 has the possibility to operate the various track working tools accordingly, for instance to change the working pressure of the lining tools and/or to adjust the tamping pressure and/or vibrating force of the tamping tools, as may be required by the sensed condition of the track.

If central monitoring and control apparatus 32 is a replaceable module, such modules with remote control means adapted to different working means on work vehicle 2 may be readily installed to increase the versatily of the arrangement and adapt it to various types of track surfacing machines.

Figure 4:
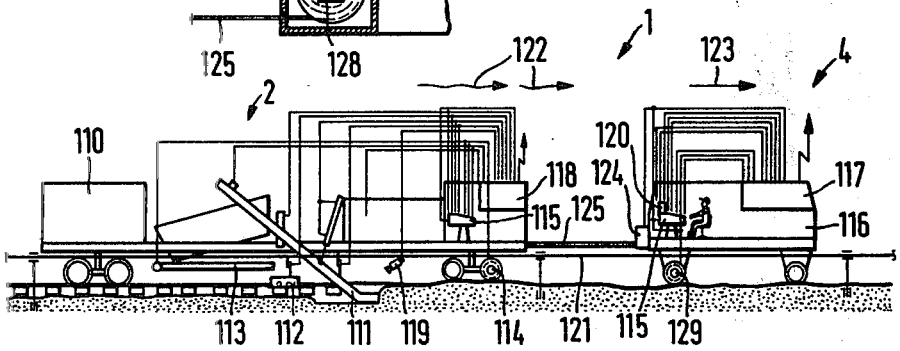
FIG. 4 is a view similar to that of FIG. 1 but showing a mobile ballast cleaning machine.

FIG. 4 shows an embodiment wherein self-propelled track working machine arrangement 1 comprises a generally conventional ballast cleaning machine 110 mounted on work vehicle 2 the operation of which is controlled from control vehicle 4. The track working means mounted on vehicle 2 include ballast excavating and conveyor chain arrangement 111, track lifting unit 112 and cleaned ballast distribution conveyor arrangement 113. Drive 114 moves vehicle 2 along the track intermittently in the direction of arrows 122 while drive 129 moves control vehicle 4 non-stop along the track in the direction of arrow 123. The ballast cleaning machine, its working means and the actuating means therefor all being conventional, they are not further described, the vehicle drives and the various actuating means being controlled by remote control means on central monitoring and control apparatus 115 in operator's cab 116 on control vehicle 4 in a manner analogous to that described hereinabove.

The transmission lines from the remote control means on central control panel 115 lead to a radio transmitter 117 on control vehicle 4 which sends the control signals emanating from the remote control means to radio receiver 118 on work vehicle 2 which houses ballast cleaning machine 110. Trunk lines lead from the radio receiver to the various actuating means whose operation is thus controlled by the remote control signals. As in the first-described embodiment, another central control panel 115 is also mounted on the work vehicle for common or alternative control of operations from this panel when it is desired, for example, to operate the ballast cleaning machine without separate control vehicle. Television cameras 119 are mounted in the range of the ballast excavating and conveyor chain arrangement to enable its positioning to be viewed on television screen 120 at the control panel in cab 116. A stationary reference system 121 is provided for controlling the vertical and lateral positioning of ballast excavating and conveyor chain arrangement 111 and track lifting and lining unit 112.

In view of the use of a radio transmitter and receiver for transmitting the operating signals from the remote control means of the central monitoring and control apparatus to the drives, the actuating means of the track working means and the viewing means, it is possible to keep control vehicle 4 at larger distances from work vehicle 2 than in the first-described embodiment wherein the signal transmission is by cables. This is particularly useful in connection with ballast cleaning machines because their work involves rather irregular advancing movement along the track, as indicated by wavering arrows 122, as compared to the steady advance of control vehicle 4, indicated by straight arrow 123. The distance between the work and control vehicles is monitored and controlled in this embodiment by electrical tape 124 extending between the facing ends of the two vehicles to measure and determine their distance.

Figure 5:
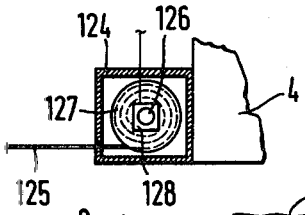
FIG. 5 is an enlarged schematic section of an electrical measuring tape provided for monitoring the distance between the work and control vehicles of the arrangement of FIG. 4.

As shown in FIG. 5, measuring tape 124 consists of a reel of thin wire 125 mounted on roller 127 having an axle 126. The roller axle is keyed to multiple-speed rotary potentiometer 128 for rotation therewith. According to the unreeled wire length between the facing ends of vehicles 2 and 4, which corresponds to their distance from each other, the electrical measuring tape potentiometer transmits distance signals to the central control panel which, in turn, has a remote control responsive to these signals for controlling the speed of drive 129 of control vehicle 4. In this manner, the distance between the vehicles is controlled.

While the present invention has been specifically described in connection with a tamping, leveling and lining machine in one embodiment and a ballast cleaning machine in another embodiment, it will be understood by those skilled in the art that the separate remote control vehicle of this invention may be used with any type of track working machine having a great variety of track working means, such as crib compactors, ballast plows, cranes and the like. All types of actuating means for all types of track working means may be controlled in any desired manner, depending on the means employed and the control signals transmitted thereto. For instance, if shoulder ballast tampers were used on machine 3, their work could be remote controlled from vehicle 4 in the same manners as the other track working means. It would also be possible to use a single separate control vehicle with a central control panel for an entire group of machines used in surfacing a track section, such as a tamping, leveling and lining machine, a ballast crib tamper and a ballast plow used in succession to surface a track. The use of a separate control vehicle will be advantageous in all track maintenance operations using track working means which, because of vibrations, noise and the like, subject their operators to undue strains eventually leading to poor efficiency.

The transmission means connecting the remote control means on the central monitoring and control apparatus to the drives, track working means and viewing means may be flexible cables, radio wave transmitters, microwave transmitters or any other suitable signal transmission means. Any type of distance control may be used to monitor and control the distance between the work and control vehicles during operation.

What is claimed is:

1. A self-propelled track working machine arrangement comprising (a) a first vehicle mounted for mobility on the track, the first vehicle including (1) a drive for moving the vehicle along the track, (b) track working means mounted on the first vehicle, (c) means for viewing the track working means, (d) means for actuating the track working means, (e) a second and separate vehicle mounted for mobility on the track and forming a train with the first vehicle, the second vehicle including (1) another drive for moving the second vehicle independently of the first vehicle along the track, (f) control means for the common control of the vehicle drives, (g) a central monitoring and control apparatus for the drives and for the track working means mounted on the second and separate vehicle, the monitoring and control apparatus including (1) remote control means for actuating the drives and for actuating the track working means, and (2) means for monitoring the viewing means, and (h) transmission means connecting the remote control means to the drives and to the actuating means for the track working means, and connecting the monitoring means to the viewing means.

2. The self-propelled track working machine arrangement of claim 1, wherein the track working means includes means for correcting the position of the track and means for surveying and indicating the track position.

3. The self-propelled track working machine arrangement of 1 or 2, further comprising another central monitoring and control apparatus for the drives and for the track working means mounted on the first vehicle, the other monitoring and control apparatus including remote control means for actuating the drives and for actuating the track working means, and another transmission means connecting the latter remote control means to the drives and to the actuating means for the track working means.

4. The self-propelled track working machine arrangement of claim 1 or 2, further comprising coupling means interconnecting facing ends of the first and second vehicles, and brake means for stopping the train.

5. The self-propelled track working machine arrangement of claim 4, wherein the control means are mounted at ends of the vehicles opposite the facing ends thereof.

6. The self-propelled track working machine arrangement of claim 1 or 2, further comprising standard railroad car couplings on the ends of the vehicles.

7. The self-propelled track working machine arrangement of claim 2, wherein the track working means includes means for tamping ballast under ties of the track, the track position correcting means includes means for vertically and laterally moving the track, the track position surveying and indicating means includes reference systems for the vertical and lateral movement of the track whereby the first vehicle constitutes a track tamping, leveling and lining machine, the remote control means for actuating the track working means includes controls for the ballast tamping means and for the track moving means, and the viewing means is mounted within view of the ballast tamping means .

8. The self-propelled track working machine arrangement of claim 7, wherein the viewing means is a television camera and the means for monitoring the viewing means is a television screen connected to the television camera.

9. The self-propelled track working machine arrangement of claim 7, wherein the drive for the second and separate vehicle is arranged for moving the second vehicle substantially non-stop along the track.

10. The self-propelled track working machine arrangement of claim 7, wherein the remote control means for actuating the track working means includes means for surveying the corrected position of the track.

11. The self-propelled track working machine arrangement of claim 10, further comprising means on the second vehicle for surveying the position of the track whereon the second vehicle moves.

12. The self-propelled track working machine arrangement of claim 1 or 2, wherein the central monitoring and control apparatus is a replaceable module, the remote control means of the module being adapted to the track working means on the first vehicle.

13. The self-propelled track working machine arrangement of claim 1 or 2, further comprising a control for monitoring and controlling the distance between the first and second vehicles.

* * * * *